US006655870B1

(12) United States Patent
Causie et al.

(10) Patent No.: US 6,655,870 B1
(45) Date of Patent: Dec. 2, 2003

(54) NARROW GAUGE ROAD PAVING APPARATUS

(76) Inventors: Steven John Causie, 268 Diamond Rd., Mason, MI (US) 48854; John Newell Causie, 1501 Vaughn Rd., Leslie, MI (US) 49251

( * ) Notice: Subject to any disclaimer, the term of this patent is extended or adjusted under 35 U.S.C. 154(b) by 0 days.

(21) Appl. No.: 10/146,225

(22) Filed: May 15, 2002

(51) Int. Cl.[7] ..... E01C 19/48; E01C 19/12
(52) U.S. Cl. ..... 404/96; 404/101; 404/103
(58) Field of Search ..... 404/96, 84.05, 404/84.1, 90, 92, 101, 103, 108

(56) References Cited

U.S. PATENT DOCUMENTS

| | | | | | |
|---|---|---|---|---|---|
| 3,915,584 | A | * | 10/1975 | Coho et al. | 404/98 |
| 3,970,405 | A | | 7/1976 | Swisher et al. | |
| 4,124,325 | A | * | 11/1978 | Cutler | 404/75 |
| 4,289,421 | A | | 9/1981 | Sampey et al. | |
| 4,310,293 | A | * | 1/1982 | Eggleton | 425/62 |
| 4,988,233 | A | * | 1/1991 | Kasler et al. | 404/108 |
| 5,018,955 | A | * | 5/1991 | Parrish et al. | 425/64 |
| 5,046,889 | A | * | 9/1991 | Sterner, Jr. | 404/103 |
| 5,190,400 | A | * | 3/1993 | Sterner | 404/103 |
| 5,354,189 | A | * | 10/1994 | McKinnon | 425/64 |
| 5,765,966 | A | * | 6/1998 | White et al. | 405/174 |
| 5,846,022 | A | * | 12/1998 | Grundl | 404/101 |
| 5,879,104 | A | | 3/1999 | Ulrich | |
| 6,129,480 | A | * | 10/2000 | Cunningham | 404/75 |
| 6,158,925 | A | * | 12/2000 | Schleining et al. | 405/179 |
| 2002/0044831 | A1 | * | 4/2002 | Leone et al. | 404/104 |

* cited by examiner

*Primary Examiner*—Thomas B. Will
*Assistant Examiner*—Alexandra K. Pechhold
(74) *Attorney, Agent, or Firm*—MacMillan, Sobanski & Todd,LLC

(57) ABSTRACT

An apparatus for paving a narrow gauge trench in a concrete roadway is adapted to be attached to a vehicle having a supply of pressurized hydraulic fluid and includes a frame having opposing ends and operable to be attached to the vehicle. The frame includes a hopper attached at a first end thereof, an auger disposed therein, and a concrete dispensing aperture extending through a lower wall thereof at a second end of the frame opposite the hopper. A strike-off member is hingedly attached to the frame and a roller is hingedly attached to the frame and extends rearwardly of the strike-off member. A hydraulic system is connected to the pressurized hydraulic fluid supply of the vehicle and is operable to control the auger, the roller, and the vertical orientation of the strike-off member and the roller. When the hydraulic system is pressurized by the fluid supply, a concrete mixture is placed into the hopper and the vehicle is oriented adjacent the trench and moved along the longitudinal axis of the trench, the strike-off member and the roller are lowered to the roadway surface, the auger moves the concrete from the first end to the second end of the frame, the concrete exits the frame from through the dispensing aperture, the strike-off member directs the concrete mixture into the trench and the roller smoothes the concrete mixture in the trench and pushes the concrete mixture farther down the trench as the vehicle moves down the longitudinal axis of the trench.

17 Claims, 7 Drawing Sheets

NARROW GAUGE ROAD PAVING APPARATUS

BACKGROUND OF THE INVENTION

The present invention relates generally to concrete paving and paving repair machines and, in particular, to a narrow gauge road repair apparatus.

Concrete road paving machines are well known. Concrete roads are typically paved utilizing fixed form paving methods or slipform paving methods. Fixed form paving methods are typically manual in nature and utilize wood or concrete forms to help the concrete achieve its desired shape. Slipform paving methods, utilizing slipform paving machines, are preferred. Slipform paving machines do not require a wood or concrete form for the concrete and are commonly self-propelled. A typical slipform road paving apparatus includes a frame, a means of self-propulsion, an auger for extruding the concrete mixture, a roller for smoothing the concrete mixture after extrusion, and a vibrating apparatus or tamper to help consolidate the concrete and ease the progress of paving by making the concrete more fluid.

A common practice for paving roads is to utilize these prior art fixed form paving methods or slipform paving machines to lay parallel lanes of concrete paving material typically corresponding in width to traffic lanes. The parallel lanes are connected at a longitudinal joint known in the art as the centerline, which is then treated with a sealant. A common problem is that the centerline often cracks and requires repair much earlier than the remainder of the road because the centerline is the weakest link in the road and allows for the introduction of moisture and incompressible materials regardless of the type of sealant used. Cracks requiring repair also occur along longitudinal expansion saw cuts for the same reasons outlined above.

To address these problems and in an effort to keep road repair costs low, many transportation agencies responsible for road repair are choosing to repair just the damaged pavement surrounding the centerline, rather than the more expensive and time-consuming choice of replacing the entire roadway. A damaged portion of each parallel lane adjacent the centerline is removed and replaced with new concrete. Typical slipform road paving machines are not suited for this type of repair because the width of the paving section is generally two feet, much less than that of prior art machines designed to pave a whole roadway or an entire lane. As a result, the repairs must be done manually, which is both expensive and time-consuming. When repaired manually, only approximately 300 feet of roadway can be repaired per day.

It is desirable, therefore, to provide a road repair apparatus for paving narrow gauge sections of a road and, in particular, to provide a road repair apparatus for use in centerline longitudinal joint removal and replacement operations.

SUMMARY OF THE INVENTION

The present invention concerns an apparatus for paving a narrow gauge trench in a concrete roadway. Preferably, the paving apparatus is utilized in centerline longitudinal joint removal and replacement operations. The paving apparatus according to the present invention includes an elongated frame having opposed ends. The frame includes a generally horizontal lower portion having a front wall and a rear wall extending upwardly therefrom, forming an open upper end and having a generally V-shaped cross section. A hopper is attached to the open upper end at one of the opposing ends of the frame. A concrete dispensing aperture extends through the lower portion of the frame at the other opposing end of the frame. An auger is disposed in and extends along the length of the a frame. The auger is rotatably attached to the opposing ends of the frame. A generally V-shaped strike-off member that is shaped to the width of the narrow gauge trench is attached to and extends downwardly from a lower portion of the frame adjacent the dispensing aperture. A roller is attached to and extends downwardly from a lower portion of the frame adjacent the strike-off member and extends rearwardly from the strike-off member. Preferably, the frame is adapted to be attached to a backhoe, tractor, or other type of vehicle having a power take-off that is operable to supply pressurized hydraulic fluid to a hydraulic system on the apparatus. The hydraulic system is the prime mover for the auger, and also controls the operation and orientation of the strike-off member and the roller through various pumps, valves, and rams.

In operation, the apparatus is attached to the vehicle, the hydraulic system is pressurized and a concrete mixture is introduced into the hopper at one end of the frame. The concrete mixture is moved toward the other end of the frame by the auger. The auger also maintains the proper mixture and keeps the concrete mixture flowing. The operator of the vehicle maneuvers the strike-off member adjacent the previously prepared trench and orients the dispensing aperture, the strike-off member, and the roller to a desired location. The concrete mixture exits the frame and is poured into the trench through the dispensing aperture. As the operator moves the vehicle forward along the longitudinal axis of the trench, the strike-off member directs the concrete mixture into the trench and moves any excess concrete further along the trench and the roller smoothes the poured concrete mixture in the trench when it passes over the poured concrete. The operator of the vehicle can advantageously change the orientation of the dispensing aperture, the strike-off member, and the roller as well as the operation of the auger and the roller during operation of the apparatus depending on the requirements of the paving. The operator of the apparatus controls the forward speed of the vehicle, the orientation of the strike-off member and the roller as well as the operation of the auger in order to fill the trench with the proper amount and location of the concrete mixture.

The apparatus according to the present invention is advantageously lightweight, portable, and inexpensive because it is operable to be attached to many types of vehicles and is not self-propelled. The apparatus allows narrow gauge trenches to be quickly and inexpensively paved. Utilizing the apparatus according to the present invention, approximately 6000 feet of roadway can be repaired per day. The apparatus provides a lightweight and portable means for paving a narrow gauge trench in a concrete roadway.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 6:
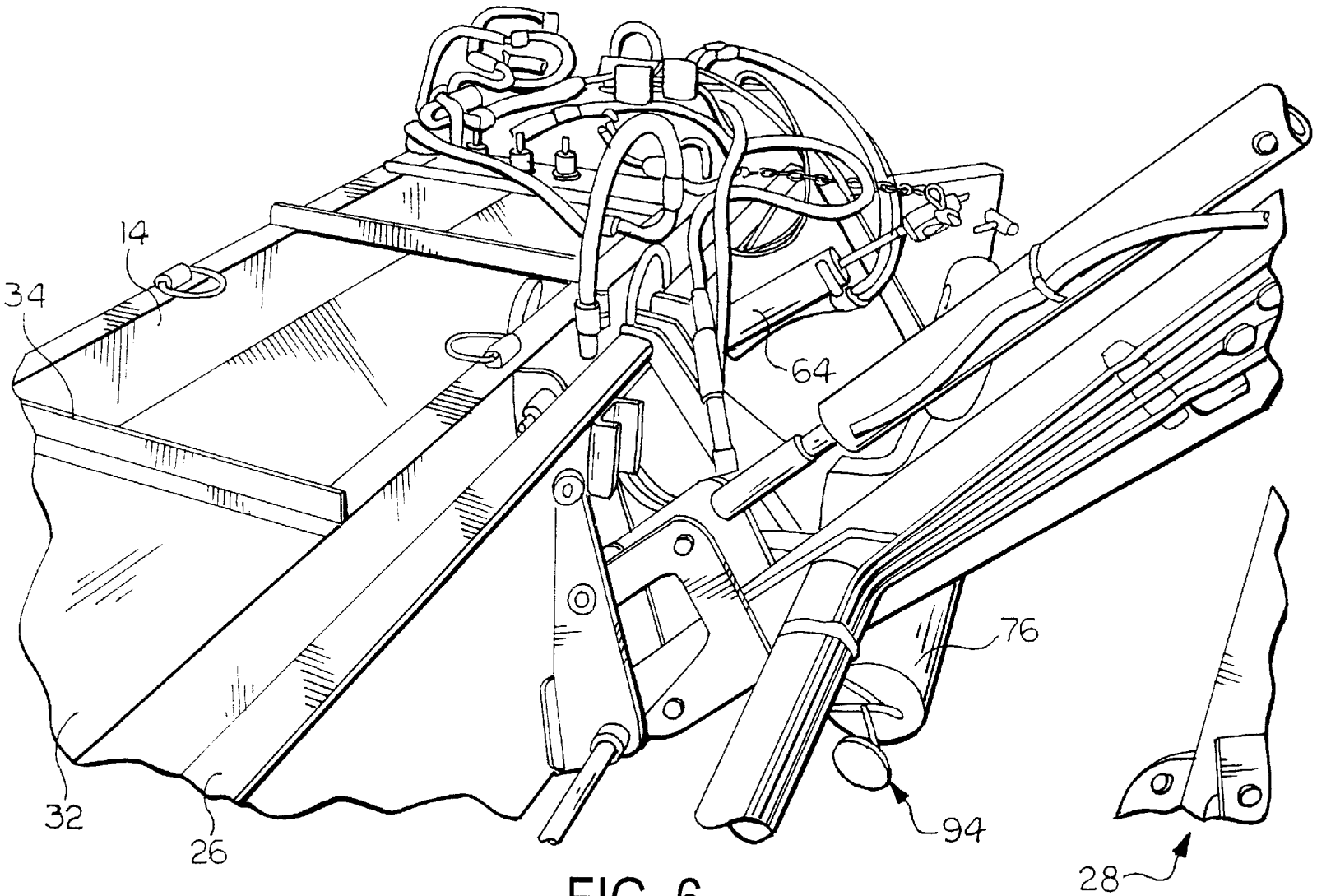
FIG. 6 is a side perspective view of the apparatus shown in FIG. 2.

Referring now to all of the drawing figures, a narrow gauge road repair apparatus according to the present invention is indicated generally at 10. The paving apparatus 10 includes an elongated frame 12 having a front wall 14 and a rear wall 16 extending upwardly from a lower wall 18, forming a generally V-shaped cross-section that defines an upper opening 20. The frame 12 includes a first end 22 and a second end 24 attached to opposite ends of the walls 14, 16 and 18 to form a receptacle. The rear wall 16 of the frame 12 includes a mounting member 26, best seen in FIG. 6, attached thereto that is operable to be attached to a vehicle, indicated generally at 28, such as a backhoe, tractor, or similar vehicle.

Figure 7:
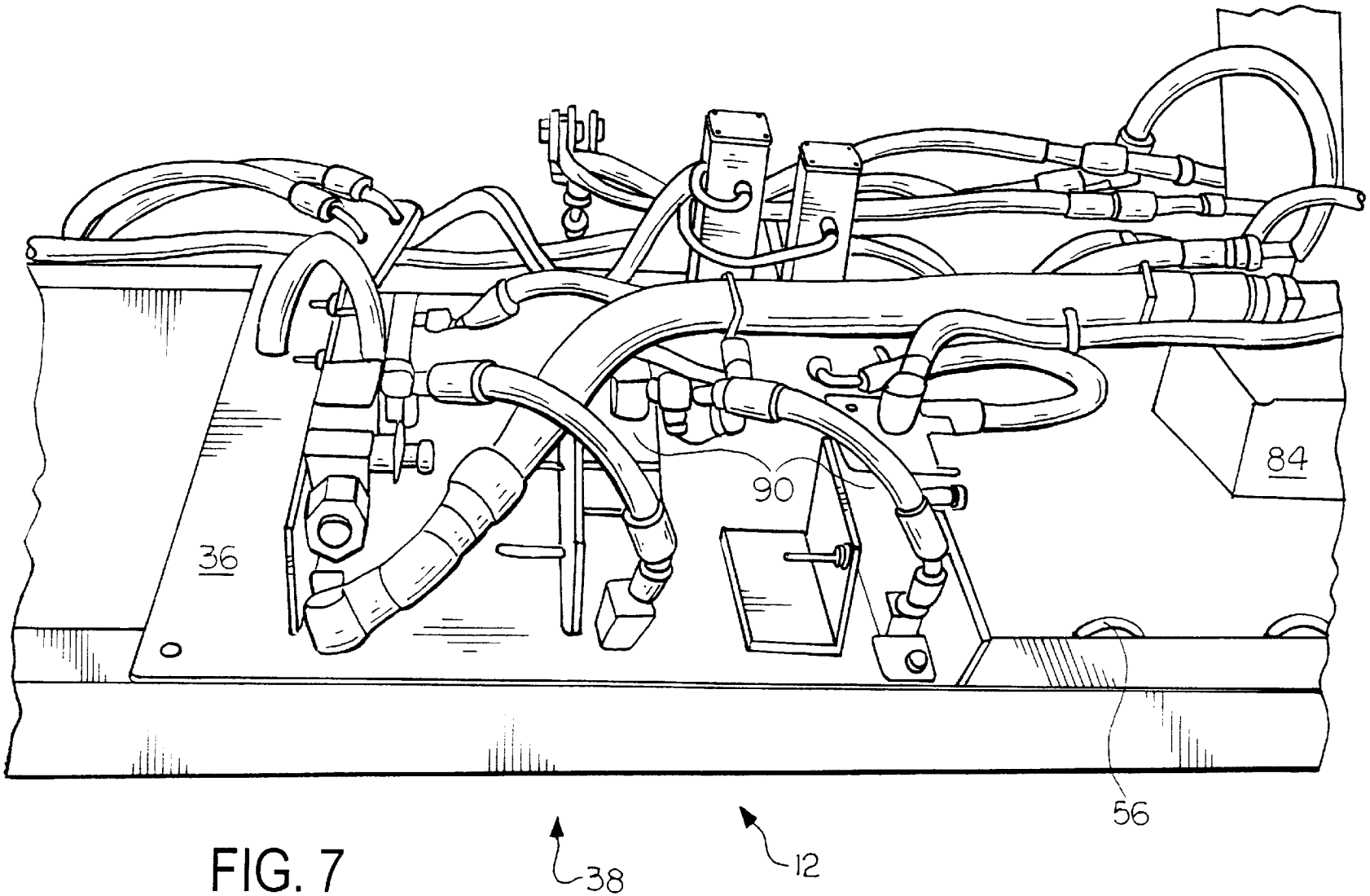
FIG. 7 is another top perspective view of the apparatus shown in FIG. 2.

A hopper 30 is attached to the first end 22 of the frame 12. The hopper 30 is operable to receive a wet concrete mixture (not shown) in an upper opening 31 thereof. A generally planar first cover member 32 is attached to respective upper surfaces of the front wall 14 and the rear wall 16 adjacent the hopper 30 and extends from the hopper 30 towards the second end 24 of the frame 12. The first cover member 32 covers the upper opening 20 of the frame 12 to a point 34 intermediate the hopper 30 and a second cover member 36, best seen in FIG. 7, attached to the frame in a similar manner. A hydraulic system, indicated generally at 38 and discussed in more detail below, is attached to an upper surface of the second cover member 36. A first wheel assembly 40 is attached to a side surface of the first end 22 of the frame 12 below the hopper 30. The first wheel assembly 40 includes a longitudinal member 42 having a front wheel 44 and a rear wheel 46 attached thereto. A second wheel assembly 48 is attached to a side surface of the second end 24 of the frame 12. The second wheel assembly 48 includes a longitudinal member 50 having a front wheel 52 and a rear wheel 54 attached thereto. The rear wheel 54 of the second wheel assembly 48 extends outwardly at an angle beyond the second end 24 of the frame 12, best seen in FIG. 4.

Figure 5:
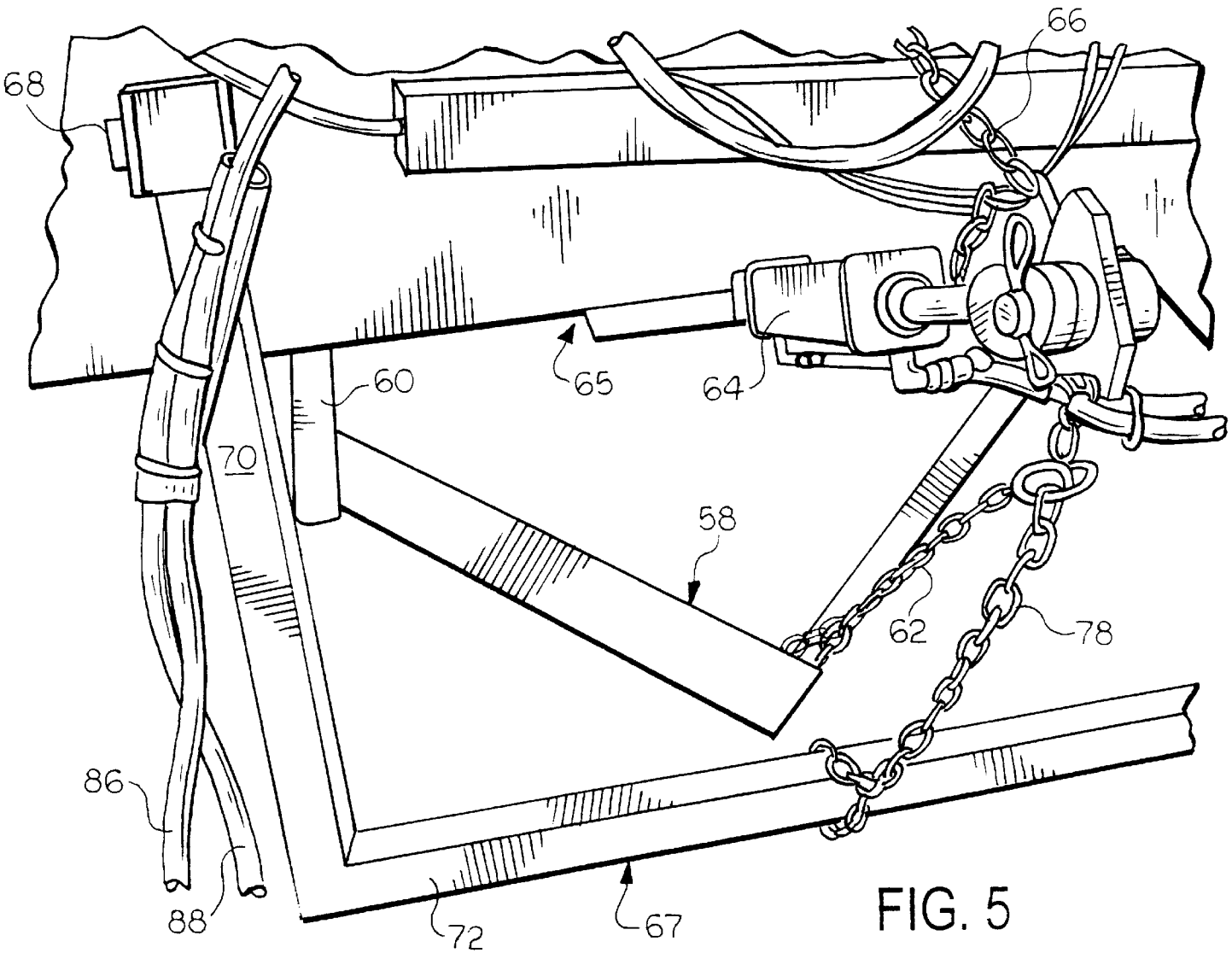
FIG. 5 is another rear perspective view of the apparatus shown in FIG. 2.

A concrete dispensing aperture 65, best seen in FIG. 5, extends through the lower wall 18 adjacent the second end 24 of the frame 12 below the hydraulic system 38. An elongated auger 56 is disposed in the frame 12 and extends along the length of the frame 12 from the hopper 30 to the dispensing aperture 65. The auger 56 is rotatably attached to the first end 22 and the second end 24 of the frame 12, preferably by a ball bearing connection or the like. A generally V-shaped strike-off member 58 is hingedly attached to two members 60 extending downwardly and rearwardly from a lower surface of the front wall 14 of the frame 12 and is suspended by a chain 62 from a strike-off member control ram 64, discussed in more detail below, which is attached by another chain 66 to an upper surface of the rear wall 16 of the frame 12. The strike-off member 58 is sized to accommodate a narrow gauge trench (not shown) in a roadway (not shown). A roller frame 67 is hingedly attached to mounting projections 68 on a lower portion of the rear wall 16 adjacent the strike-off member 58 and includes longitudinal members 70 which extend downwardly to join with opposing ends of a transverse member 72. Roller mounting plates 74 are attached to the outer surface of the transverse member 72 and rotatably receive opposed ends of a roller 76, which extends rearwardly from the strike-off member 58. The transverse member 72 is suspended by another chain 78 from the strike-off member control ram 64.

Figure 1:
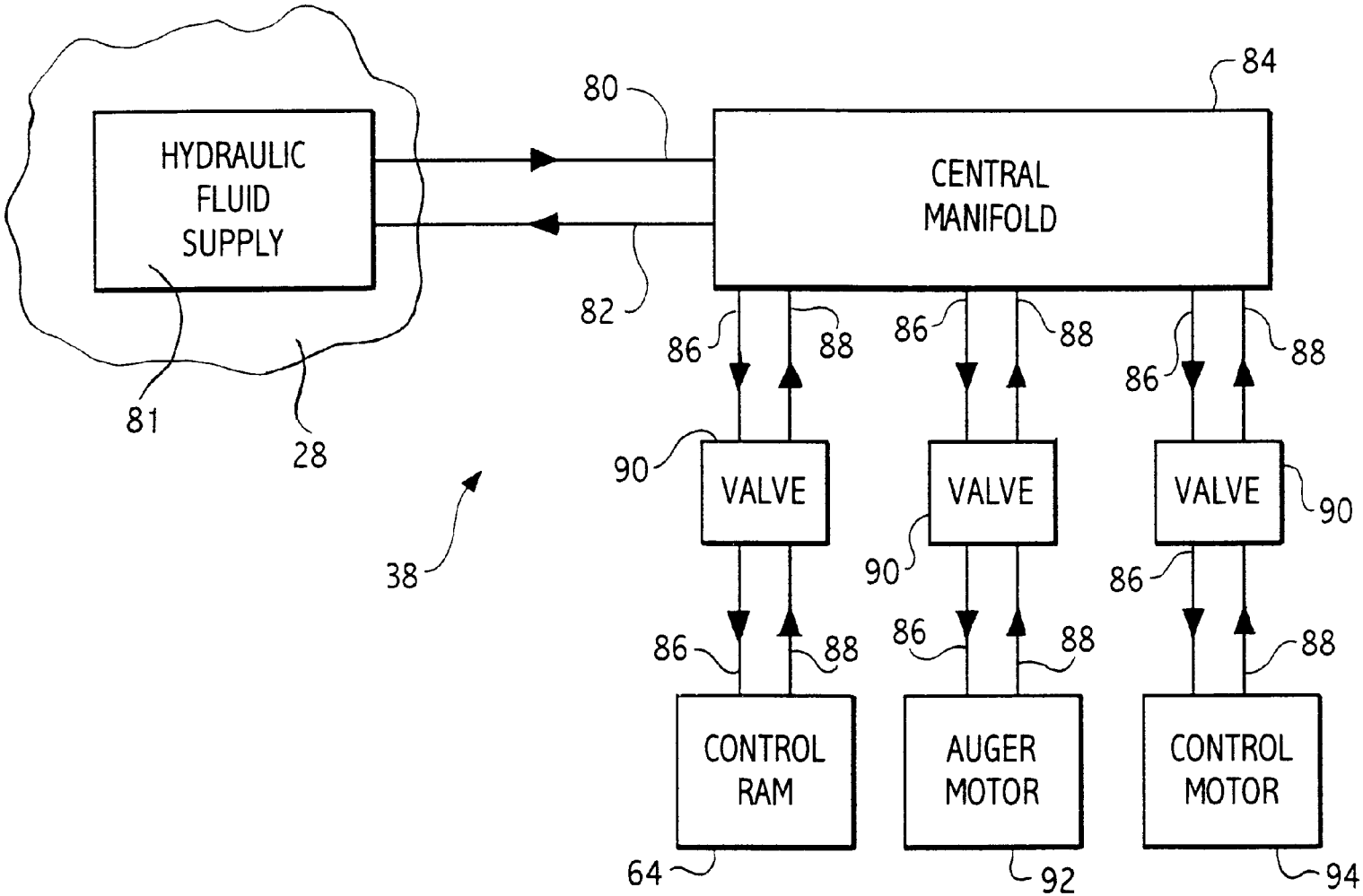
FIG. 1 is a view of a block diagram of a hydraulic system for use with an apparatus in accordance with the present invention.
Figure 2:
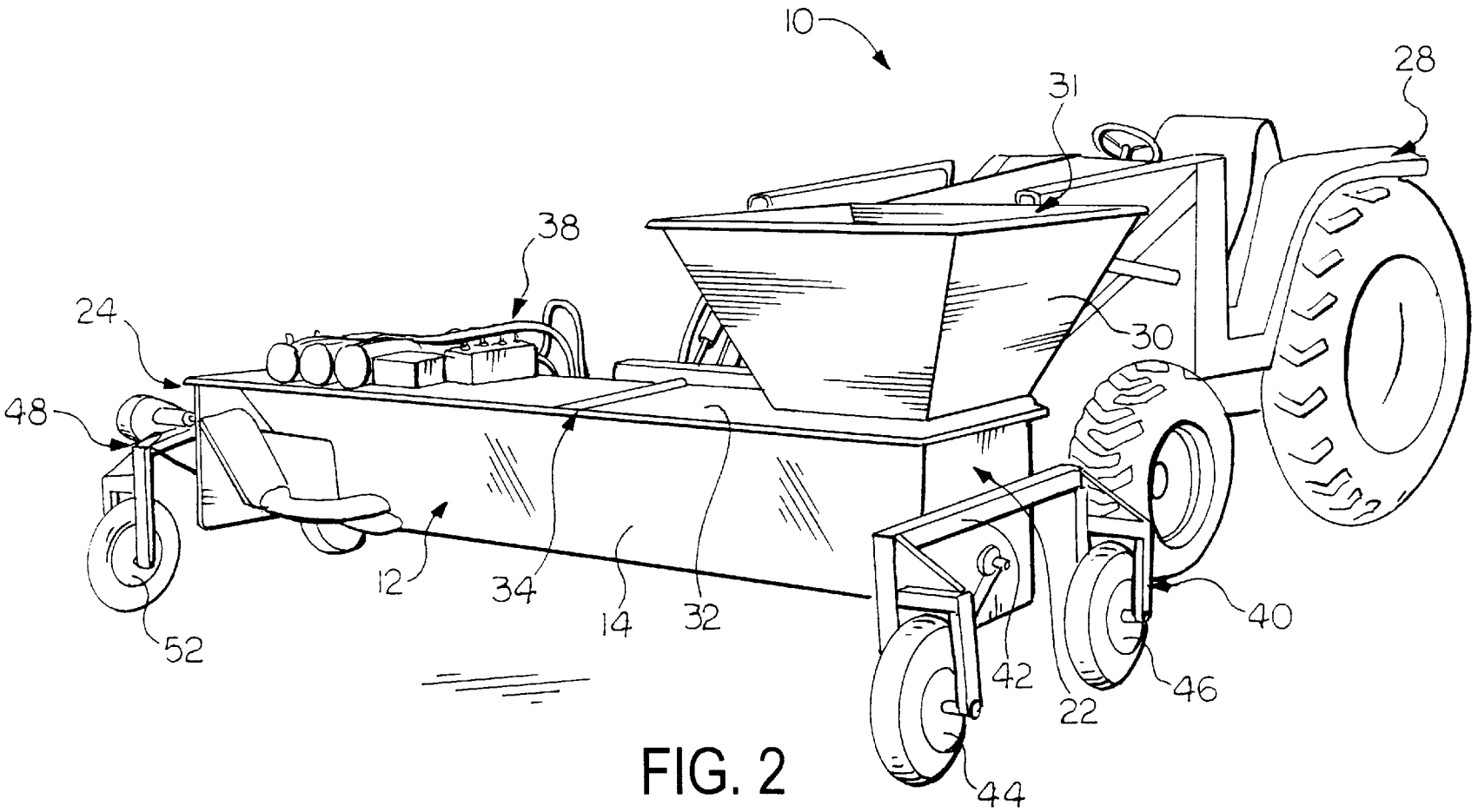
FIG. 2 is a front perspective view of a narrow gauge road repair apparatus according to the present invention.
Figure 3:
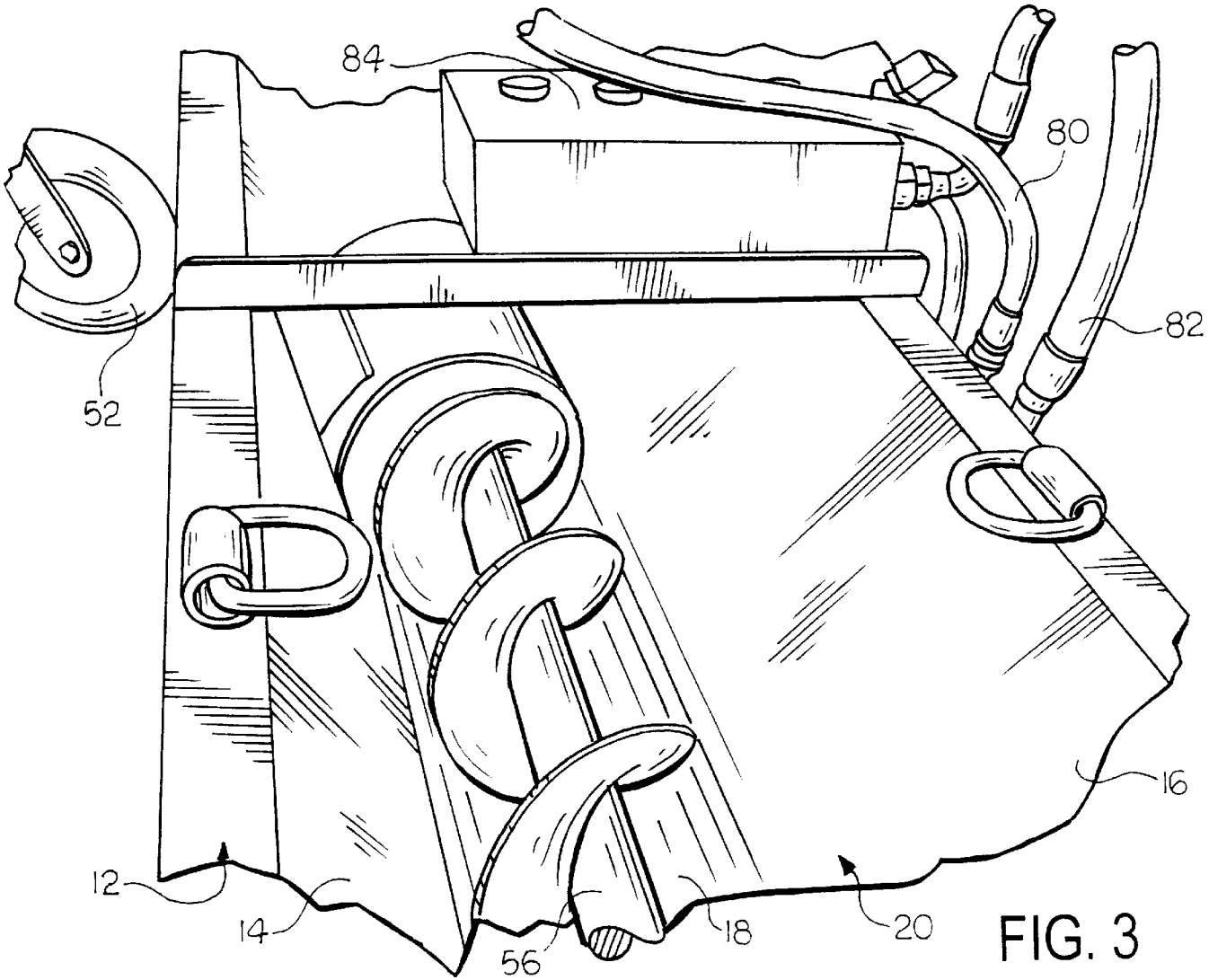
FIG. 3 is a top perspective view of the apparatus shown in FIG. 2.

The hydraulic system 38 includes an inlet connection 80 and an outlet connection 82 that supplies hydraulic fluid (not shown) from a pressurized hydraulic fluid supply 81, best seen in FIG. 1, on the vehicle 28, such as by a power take-off or the like, to a central header or manifold 84. The manifold 84 supplies the hydraulic fluid to a plurality of inlet conduits 86 and receives the fluid from a plurality of outlet conduits 88 extending therefrom. The conduits 86 and 88 are connected to a plurality of electrically actuated valves 90. The valves 90, when actuated by a controller (not shown), supply hydraulic fluid to a hydraulic auger motor 92, the strike-off member control ram 68, and a hydraulic roller motor 94. The hydraulic auger motor 92 rotates the auger 56 via a chain or belt (not shown). The strike-off member control ram 64 controls the vertical orientation of the strike-off member 58 and the roller 76. The hydraulic roller motor 94 rotates the roller 76.

Figure 4:
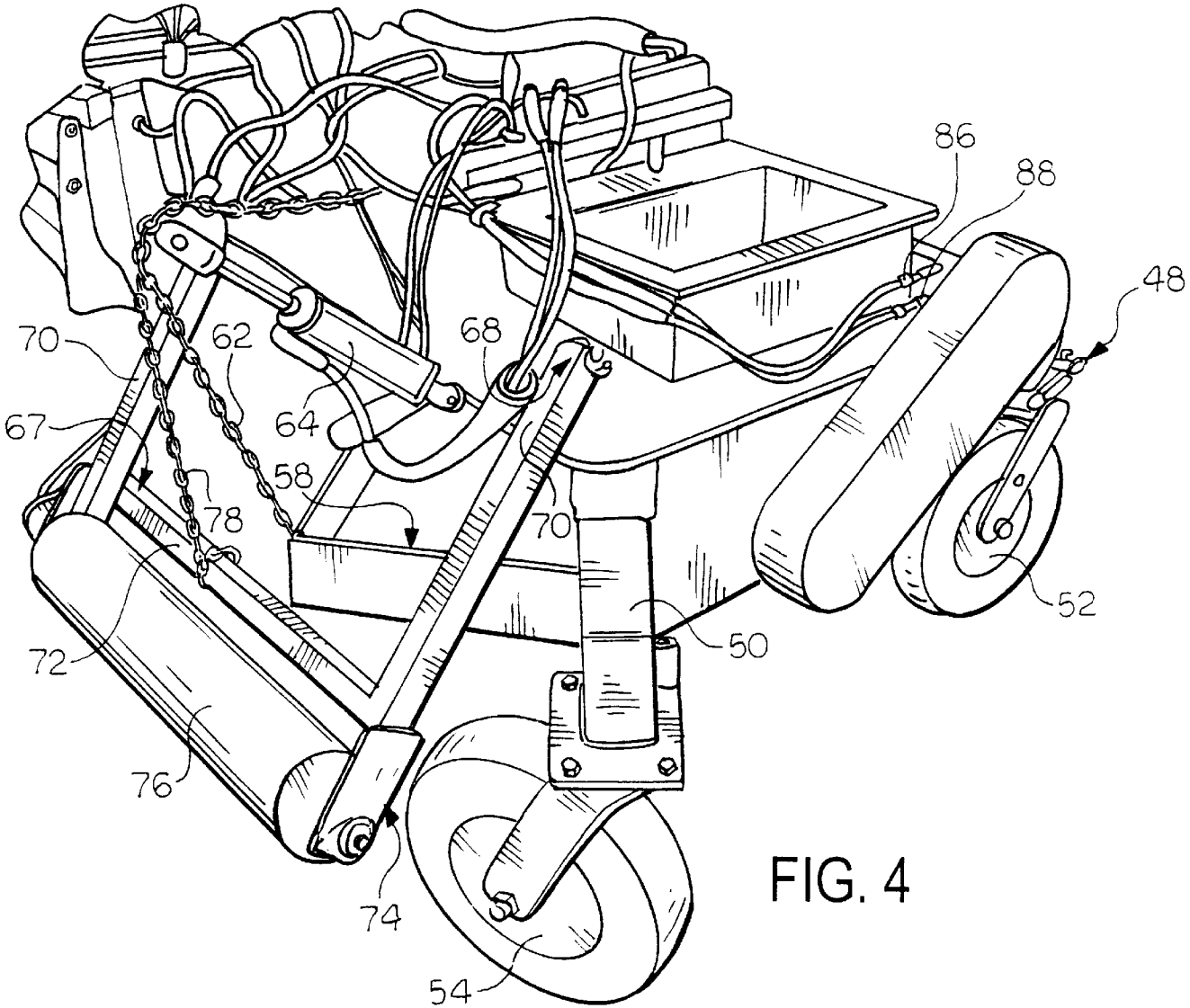
FIG. 4 is a rear perspective view of the apparatus shown in FIG. 2.

Preferably, the dispensing aperture 65, the strike-off member 58, and the roller 76 are located to a side of the vehicle 28, best seen in FIG. 4, so the paving apparatus 10 may be utilized and viewed from within the vehicle 28 during operation. Alternatively, the dispensing aperture 65, the strike-off member 58, and the roller 76 are located directly in front of the vehicle 28, which straddles the trench.

In operation, the paving apparatus 10 is attached to the vehicle 28, the hydraulic system 38 is pressurized and the wet concrete mixture is introduced into the hopper 30 at the first end 22 of the frame 12. When the hydraulic system 38 is pressurized, the valves 90, the hydraulic auger motor 92, the strike-off member control ram 64, and the hydraulic roller motor 94 are energized, enabling the operation of the strike-off member 58, the roller 76, and the auger 56. The concrete mixture is fed from the hopper 30 into the interior of the frame 12 and is moved toward the second end 24 of the frame 12 by the auger 56, which is actuated by the hydraulic auger motor 92. The auger 56 also maintains the proper liquidity for the concrete mixture in order to keep the concrete mixture flowing. The operator of the vehicle (not shown) maneuvers the strike-off member 58 above and adjacent the previously prepared trench (not shown) in the roadway surface (not shown) and orients the dispensing aperture 65, the strike-off member 58, and the roller 76 to a desired location. The concrete mixture exits the frame 12 and is poured into the trench through the dispensing aperture 65. The strike-off member 58 is preferably lowered by the strike-off member control ram 64 so that a lower surface of the strike-off member 58 is touching the roadway surface. As the operator moves the vehicle 28 forward along the longitudinal axis of the trench, the strike-off member 58 skims the roadway surface and directs the concrete mixture into the trench and moves any excess concrete further along the trench. The roller 76 is rotated by the roller motor 94 in a direction opposite the travel of the vehicle 28 in order to smooth the poured concrete mixture in the trench and to push the concrete mixture farther down the trench. The operator of the vehicle 28 can advantageously change the orientation of the strike-off member 58 and the roller 76 as well as the operation of the auger 56 and the roller 76 during operation of the paving apparatus 10 depending on the requirements of the paving by starting, stopping, or varying the hydraulic fluid flow to the valves 90, the auger motor 92, the strike-off member control ram 64, and the roller motor 94.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. An apparatus for paving a narrow gauge trench in a concrete roadway while being moved along the trench by a vehicle, the apparatus comprising:

a roadway surface engaging movable frame having walls extending between opposed ends and adapted to be attached to a vehicle, said ends being spaced apart a distance greater than a predetermined trench width;

an auger rotatably disposed in said frame extending between said opposed ends of said frame;

a hopper attached to said frame for feeding wet concrete from a source of wet concrete into said frame at one end of said auger;

a concrete dispensing aperture formed through a lower one of said walls of said frame adjacent another end of said auger, whereby when said frame is positioned on a roadway with said ends of said frame on opposite sides of the predetermined width trench and said concrete dispensing aperture over the trench, said hopper is provided with wet concrete from the source of wet concrete and feeds the wet concrete to said auger, and said auger is rotated to move the wet concrete from said hopper to exit said frame through said concrete dispensing aperture, movement of said frame along a longitudinal axis of the trench at a predetermined speed fills the trench with the wet concrete; and a strike-off member attached to said frame rearwardly of said concrete dispensing aperture for engaging the roadway surface on either side of the trench and leveling the wet concrete dispensed into the trench, said strike-off member being hingedly attached to said frame for movement between a raised inoperative position and a lowered position engaging the roadway surface.

2. The apparatus according to claim 1 including a plurality of wheel assemblies attached to said frame for engaging the roadway surface.

3. The apparatus according to claim 1 wherein said strike-off member is generally V-shaped.

4. The apparatus according to claim 1 including a roller attached to said frame rearwardly of said concrete dispensing aperture and having a roller axis of rotation extending generally parallel to an axis of rotation of said auger for engaging the roadway surface on either side of the trench and smoothing the wet concrete dispensed into the trench.

5. The apparatus according to claim 4 including means for rotating said roller about said roller axis of rotation in a direction opposite a travel direction of said frame along the trench.

6. The apparatus according to claim 5 wherein said roller is hingedly attached to said frame for movement between a raised inoperative position and a lowered position engaging the roadway surface.

7. The apparatus according to claim 1 including a hydraulic system adapted to be connected to a hydraulic fluid supply of the vehicle, said hydraulic system being selectively operable to rotate said auger.

8. The apparatus according to claim 7 wherein said hydraulic system is selectively operable to move said strike-off member between the raised inoperative position and the lowered position engaging the roadway surface.

9. The apparatus according to claim 7 including a roller attached to said frame rearwardly of said concrete dispensing aperture and having a roller axis of rotation extending generally parallel to an axis of rotation of said auger for engaging the roadway surface on either side of the trench and smoothing the wet concrete dispensed into the trench, said hydraulic system being selectively operable to rotate said roller about said roller axis of rotation in a direction opposite a travel direction of said frame along the trench.

10. The apparatus according to claim 8 including a roller hingedly attached to said frame rearwardly of said concrete dispensing aperture for engaging the roadway surface on either side of the trench and smoothing the wet concrete dispensed into the trench, said hydraulic system being selectively operable to move said roller between a raised inoperative position and a lowered position engaging the roadway surface.

11. An apparatus for paving a narrow gauge trench in a concrete roadway while being moved along the trench by a vehicle, the apparatus comprising:

a roadway surface engaging movable frame having walls extending between opposed ends and adapted to be attached to a vehicle, said ends being spaced apart a distance greater than a predetermined trench width;

an auger rotatably disposed in said frame extending between said opposed ends of said frame;

a hydraulic system adapted to be connected to a hydraulic fluid supply of the vehicle, said hydraulic system being selectively operable to rotate said auger;

a hopper attached to said frame for feeding wet concrete from a source of wet concrete into said frame at one end of said auger; and a concrete dispensing aperture formed through a lower one of said walls of said frame adjacent another end of said auger, whereby when said frame is positioned on a roadway with said ends of said frame on opposite sides of the predetermined width trench and said concrete dispensing aperture over the trench, said hopper is provided with wet concrete from the source of wet concrete and feeds the wet concrete to said auger, and said auger is rotated to move the wet concrete from said hopper to exit said frame through said concrete dispensing aperture, movement of said frame along a longitudinal axis of the trench at a predetermined speed fills the trench with the wet concrete; and a roller hingedly attached to said fame rearwardly said concrete dispensing aperture and having a roller axis of rotation extending generally parallel to an axis of rotation of said auger for engaging the roadway surface on either side of the trench and smoothing the wet concrete dispensed into the trench, said roller being movable by said hydraulic system between a raised inoperative position and a lowered position engaging the roadway surface.

12. The apparatus according to claim 11 including a plurality of wheel assemblies attached to said frame for engaging the roadway surface.

13. The apparatus according to claim 11 including a strike-off member hingedly attached to said frame rearwardly of said concrete dispensing aperture for engaging the roadway surface on either side of the trench and leveling the wet concrete dispensed into the trench, said strike-off member being movable by said hydraulic system between a raised inoperative position and a lowered position engaging the roadway surface.

14. The apparatus according to claim 13 wherein said strike-off member is generally V-shaped.

15. The apparatus according to claim 11 including means responsive to said hydraulic system for rotating said roller about said roller axis of rotation in a direction opposite a travel direction of said frame along the trench.

16. An apparatus for paving a narrow gauge trench in a concrete roadway while being moved along the trench by a vehicle, the apparatus comprising:

a roadway surface engaging movable frame having walls extending between opposed ends and adapted to be attached to a vehicle, said ends being spaced apart a distance greater than a predetermined trench width;

an auger rotatably disposed in said frame extending between said opposed ends of said frame;

a hopper attached to said fame for feeding wet concrete from a source of wet concrete into said frame at one end of said auger; and a concrete dispensing aperture formed through a lower one of said walls of said fame adjacent another end of said auger, a strike-off member hingedly attached to said frame;

a roller hingedly attached to said same;

a hydraulic system adapted to be connected to a hydraulic fluid supply of the vehicle, said hydraulic system being selectively operable to rotate said auger, raise and lower said strike-off member and raise and lower said roller, whereby when said frame is positioned on a roadway with said ends of said fame on opposite sides of the predetermined width trench and said concrete dispensing aperture over the trench, said hopper is provided with wet concrete from the source of wet concrete and feeds the wet concrete to said auger, and said auger is rotated to move the wet concrete from said hopper to exit said fame through said concrete dispensing aperture, movement of said frame along a longitudinal axis of the trench at a predetermined speed fills the trench with the wet concrete, levels the wet concrete in the trench with said strike-off member in said lowered position, and smoothes the wet concrete in the trench with said roller in said lowered position.

17. The apparatus according to claim 16 including a plurality of wheel assemblies attached to said frame for engaging the roadway surface.

* * * * *